US011659864B2

(12) United States Patent
Guo

(10) Patent No.: US 11,659,864 B2
(45) Date of Patent: May 30, 2023

(54) ELECTRONIC CIGARETTE BURNER ELEMENT

(71) Applicant: Ruyun Guo, Shenzhen (CN)

(72) Inventor: Ruyun Guo, Shenzhen (CN)

( * ) Notice: Subject to any disclaimer, the term of this patent is extended or adjusted under 35 U.S.C. 154(b) by 406 days.

(21) Appl. No.: 16/941,166

(22) Filed: Jul. 28, 2020

(65) Prior Publication Data

US 2022/0030943 A1 Feb. 3, 2022

(51) Int. Cl.

| | |
|---|---|
| ***A24F 40/46*** | (2020.01) |
| ***A24F 40/10*** | (2020.01) |
| ***A24F 40/44*** | (2020.01) |
| ***A24F 40/485*** | (2020.01) |
| ***H05B 3/48*** | (2006.01) |
| ***H05B 3/12*** | (2006.01) |

(52) U.S. Cl.

CPC ..... *A24F 40/46* (2020.01); *A24F 40/10* (2020.01); *A24F 40/44* (2020.01); *A24F 40/485* (2020.01); *H05B 3/12* (2013.01); *H05B 3/48* (2013.01); *H05B 2203/002* (2013.01); *H05B 2203/017* (2013.01)

(58) Field of Classification Search

CPC ..... A24F 40/10; A24F 40/44; A24F 40/46; A24F 40/486; H05B 3/12; H05B 3/48; H05B 2203/002; H05B 2203/017; C04B 35/10

USPC ..... 131/329

See application file for complete search history.

(56) References Cited

U.S. PATENT DOCUMENTS

| | | | | |
|---|---|---|---|---|
| 9,763,477 | B2 | 9/2017 | Zhu | |
| 2013/0192616 | A1* | 8/2013 | Tucker et al. | A24F 47/008 131/328 |
| 2016/0192710 | A1 | 7/2016 | Liu | |
| 2016/0302486 | A1* | 10/2016 | Eroch | A24F 47/008 |
| 2017/0035119 | A1 | 2/2017 | Otto | |
| 2017/0156401 | A1* | 6/2017 | Liu | A24F 47/008 |
| 2018/0289058 | A1 | 10/2018 | Chen | |
| 2019/0274353 | A1 | 9/2019 | Sur | |
| 2019/0274356 | A1* | 9/2019 | Deng et al. | A24F 47/008 |
| 2020/0367564 | A1* | 11/2020 | Li et al. | A24F 40/46 |

FOREIGN PATENT DOCUMENTS

| | | | | |
|---|---|---|---|---|
| CN | 110757717 A | * | 2/2020 | C04B 35/10 |

OTHER PUBLICATIONS

CN 110757717 A—Machne English Translation (Year: 2020).*

* cited by examiner

*Primary Examiner* — Michael J Felton

*Assistant Examiner* — Ronnie Kirby Jordan

(74) *Attorney, Agent, or Firm* — Clement Cheng

(57) ABSTRACT

An electronic cigarette burner element has a heating wire, a porous ceramic matrix, and outer cover, holes in the outer cover, and a ventilation air passage through the porous ceramic matrix. The heating wire is configured to heat and atomize vape oil. The heating wire is formed with a coil and a pair of leads including a first lead and a second lead. A porous ceramic matrix encapsulates the coil of the heating wire. A heating body is formed when the heating wire is encapsulated by the porous ceramic matrix. An outer cover can be made of metal and can fit over the heating body. A hole is formed on the outer covet to receive vape oil. The vape oil wicks through the porous ceramic matrix like a sponge receiving water. A ventilation air passage is formed along a surface of the porous ceramic matrix.

20 Claims, 4 Drawing Sheets

ELECTRONIC CIGARETTE BURNER ELEMENT

FIELD OF THE INVENTION

The present invention is in the field of electronic cigarette burner elements.

DISCUSSION OF RELATED ART

Electronic cigarettes are electronic resistance heaters that imitate combustion based cigarettes. Electronic cigarettes can be used to quit smoking and to replace cigarettes. The e-cigarette has a built-in heating element, and the smoke oil containing nicotine is heated into a gas such as smoke or vapor through atomization, and then the user smokes from the mouthpiece. At present, the heating element of the existing electronic cigarette uses the tobacco cotton or wool to conduct oil, and then uses the heating wire to generate vape gas. The traditional electronic cigarette has a fabric wick that suffers from being easily scorched, having inconsistent wicking, and is labor-intensive to install.

For example, in U.S. Pat. No. 9,763,477 entitled Ceramic Heating Elements For Electronic Cigarettes by inventor Xiaochun Zhu, published Sep. 19, 2017 the abstract discloses, "An electronic cigarette having ceramic heating element with a heating rod has: (a) a hollow atomizing stem, (b) a first conductive ring sleeved at bottom of atomizing stem and airproof with atomizing stem, (c) a second conductive ring placed in and insulated from first conductive ring, (d) a conduit positioned in atomizing stem, with conduit base tightly contacting first conductive ring, (e) a liquid blocker positioned on top of atomizing stem, (f) a cigarette mouthpiece located on top of the atomizing stem and holds liquid blocker, and (g) a heating rod. The inner wall of atomizing stem, outer wall of conduit, top of first conductive ring, and bottom of liquid blocker together form a liquid storage chamber for storing e-liquid. In one embodiment, the heating rod can be a solid ceramic heating rod. In another embodiment, the heating rod can be a hollow ceramic heating rod."

Also for example, in United States publication number US20190274353A1 entitled Buck Regulator With Operational Amplifier Feedback For An Aerosol Delivery Device by inventor Rajesh Sur, published Sep. 12, 2019 the abstract discloses, "An aerosol delivery device is provided that includes a heating element configured to convert electricity to heat and thereby vaporize components of an aerosol precursor composition, and a control component coupled to and configured to controllably power the heating element. The control component includes a buck regulator circuit coupled to the heating element, and an operational amplifier circuit coupled to the heating element and buck regulator circuit. The buck regulator circuit is configured to step down voltage and step up current from a power source to the heating element to thereby power the heating element. The operational amplifier circuit is configured to amplify an output voltage from the heating element to produce a higher voltage that is fed back to the buck regulator circuit, which is configured to use the higher voltage to regulate an output voltage from the buck regulator circuit to the heating element."

For example, in United States publication number US20180289058A1 Electronic Cigarette and Atomizer Thereof by inventor Zhiping CHEN, published Sep. 22, 2011 the abstract discloses, "An atomizer includes a main body defining an airflow channel and a liquid storage cavity isolated from each other and an atomizing element. The atomizing element includes a porous body and a porous heating film. The porous body includes an atomizing surface and a liquid absorption surface. The atomizing surface is a plane and is substantially parallel to a direction of an air flow in the airflow channel, and the porous heating film is formed on the atomizing surface. The liquid absorption surface can absorb a liquid in the liquid storage cavity."

For example, in the United States publication number US20160192710A1 Atomization Assembly And Electronic Cigarette by inventor Qiuming Liu, published Jul. 7, 2016 the abstract discloses, "An atomization assembly and an electronic cigarette are provided by the present application, the atomization assembly includes a liquid storage assembly and an atomization core assembly. The liquid storage assembly includes a liquid storage sleeve and a vapor pipe. The atomization core assembly includes an atomizing seat and an electric heating wire element. One end of the atomizing seat is covered with a cup cover, and an opening of the liquid storage chamber is covered by an end surface of the cup cover. A liquid guiding hole is provided at an area of the end surface of the cup cover, and a vapor hole is provided at an area of the end surface of the cup cover. A liquid guiding plate is provided at one side of the end surface of the cup cover. Thus, the liquid storage assembly and the atomization core assembly can be easily assembled."

For example, in United States publication number US20170035119A1 Non-Porous Atomizer Chamber by inventor Desmond Gregory Otto, published Feb. 9, 2017 the abstract discloses, "A nonporous atomizer chamber atomizes a tobacco substance and is operable with a vaporizer. The chamber is fabricated from a nonporous material composition that is generally not permeable to water, gas, or other fluids. The nonporous material is effective for use with the chamber, where high temperatures create chemical reactions with the tobacco substance that cause absorption into the pores of a housing of the chamber. This creates undesirable toxic cumulates that leave aftertaste, off gas, and discolor in the housing. The housing atomizes the tobacco substance with a uniquely disposed heating coil. The heating coil takes three different possible positions, with each position creating a synergy with the nonporous material of the chamber to provide optimal atomization. A flat, coplanar position with a closed end of the housing prevents blockage of holes. A transverse disposition heats up efficiently. A longitudinal disposition occupies large volume area in the housing."

SUMMARY OF THE INVENTION

The present invention is an improvement in the heating element for electronic cigarettes. Electronic cigarettes have an electrical resistance heated wire and generally they have a reliability and efficiency deficiency in part due to the small size construction which the present invention seeks to improve. The present invention heating element, also called burner element is self-contained.

An electronic cigarette heater element has a heating wire body and a stainless steel cover that covers the heating wire body. The black ceramic body can be sintered together with the stainless steel cover tube. The stainless steel cover tube is formed as a cylindrical shaped tube. The heating body is made of a ceramic matrix formed around a heating wire coil. The two materials are sintered together to form a new electronic cigarette heating body. The stainless steel cover preferably has four symmetrical circular through holes. Vape oil, also called electronic vaporizer oil, or smoke oil can enter the ceramic portion through the hole in the stainless steel cover. The oil can penetrate into the heating wire due to the porous wick nature of the ceramic. Oil near the heating wire is heated and emits a vapor that is drawn away from the ceramic heating element. A variety of different concentrations of oil can be used in conjunction with the electronic cigarette cover. The design avoids use of oil-absorbing cotton wicks which can scorch or otherwise denature under certain heat conditions.

The electronic cigarette burner element has a heating wire, a porous ceramic matrix, and outer cover, holes in the outer cover, and a ventilation air passage through the porous ceramic matrix. The heating wire is configured to heat and atomize vape oil. The heating wire is formed with a coil and a pair of leads including a first lead and a second lead. A porous ceramic matrix encapsulates the coil of the heating wire. A heating body is formed when the heating wire is encapsulated by the porous ceramic matrix. An outer cover can be made of metal and can fit over the heating body. A hole is formed on the outer cover to receive vape oil. The vape oil wicks through the porous ceramic matrix like a sponge receiving water. A ventilation air passage is formed along a surface of the porous ceramic matrix. The passage can be through the porous ceramic matrix, or along the side of the porous ceramic matrix. The ventilation air passage emits a vape gas when the coil heats the vape oil. The ventilation air passage is configured to receive fresh air and is configured to exhaust the gas.

A power supply supplies power to the first lead and the second lead. The electronic cigarette burner element optionally has a second hole, a third hole and a fourth hole formed on the sidewall of the outer cover. A number of circular holes can be formed on the outer cover. The holes could be rectangular or square. For example, the intake holes could be a dozen or more holes, or a screen configuration. The intake holes could be in the middle of the tube, or the top part of the tube and not necessarily limited to the bottom part of the tube.

The ventilation air passage passes through the coil of the heating wire, and also passes through the porous ceramic matrix. The ventilation air passage can be cylindrical with a ventilation air passage central axis that is coaxial to the heating wire coil central axis. Additional ventilation air passages can be formed as micro air passages that pass through the central column so that there is more than one ventilation air passage. The porous ceramic matrix has a tube shape. An upper cavity is formed above the heating body, and the upper cavity is configured to prevent user oil aspiration. The lower cavity is formed below the heating body, and can be configured to store the vape oil. The outer cover is preferably made of stainless steel. The heating body can be sintered to the outer cover for secure attachment. The heating wire may have a nickel-chromium composition.

The first lead and the second lead of the heating wire are arranged in parallel and connected to the power supply, which can be a low-voltage DC direct current power supply. Preferably, the porous ceramic matrix encapsulating the coil of the heating wire includes activated carbon particles mixed into the ceramic matrix.

Is an object of the present invention to ameliorate certain defects of the prior art. Fiber-based wicks are less uniform. When the heating wire is in a high-temperature heating state for a long time, the smoke oil in the atomizer is easily dried which results in easy scorching of the oil-absorbing cotton or wool wick. It is a further object of the present invention to provide a more stable and even heating.

The following call out list can be a useful guide for referencing the call out numbers of the drawings.

36 Ceramic Matrix
37 Activated Carbon Particles
39 Outer Surface
38 Voids
20 Heater Unit
31 Upper Lead Wire Connection
22 Upper Opening
35 Heater Outside Sidewall
33 First Lead Wire
21 Lower Opening
30 Lead Wires
32 Lower Lead Wire Connection
34 Second Lead Wire
25 Coil Windings
23 First Coil Winding
24 Second Coil Winding
26 Internal Coil Cavity
27 Heater Inside Sidewall
28 First Lead Wire Tip
29 Second Lead Wire Tip
40 Cover
41 First Side Cover Opening
42 Second Side Cover Opening
100 Cover Sidewall
44 Cover Top Opening
48 Porous Material
45 Ceramic Core
43 Third Side Cover Opening
46 Second Lead Wire Connection
47 First Lead Wire Connection
81 Upper Cavity
82 Lower Cavity
83 Oil Inlet Holes
84 Vape Gas
85 Airflow
86 Vape Oil
87 Ventilation Air Passage
88 Heating Wire
89 External Power Source

DETAILED DESCRIPTION OF THE PREFERRED EMBODIMENT

Figure 1:
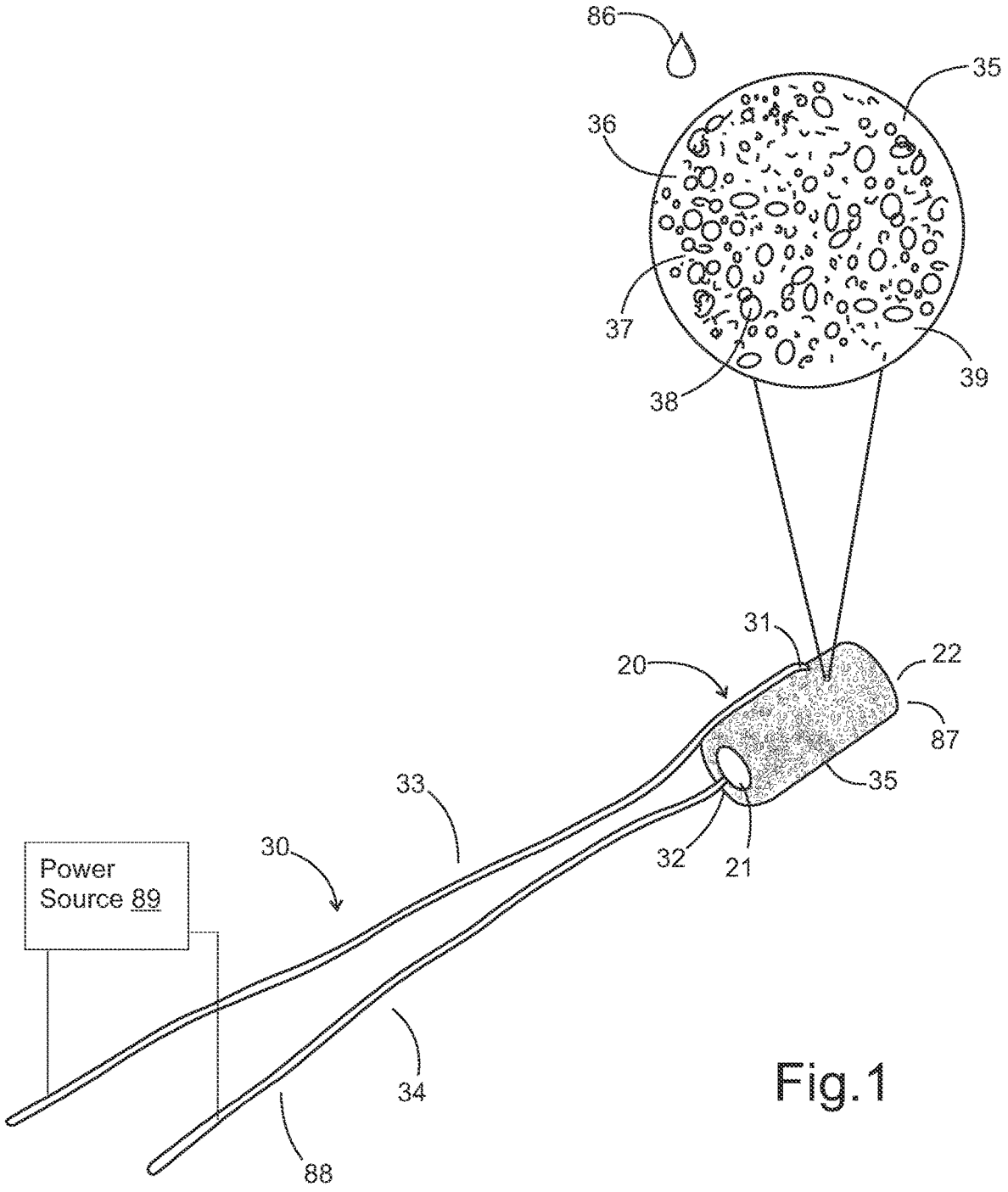
FIG. 1 is a diagram showing construction of a heater unit.

As seen in FIG. 1, a heating wire 88 has an electrical power supply 89 supplying a current to the heating wire 88. The heating wire 88 is an electrical resistance heater that operates on direct-current low voltage. The heating wire 88 has a pair of lead wires 30 that are terminated at a tip where a coil forms the tip. The lead wires 30 includes a first lead wire 33 and a second lead wire 34. The first lead wire 33 connects to an upper lead wire connection 31, and the second lead wire connects to a lower lead wire connection 32. The upper lead wire connection 33 begins the coil of the first lead wire and the lower lead wire connection 32 begins the coil of the second lead wire 34. The coils connect to each other such that the heating wire 88 is a continuous wire with a pair of ends that are electrically powered.

The heater unit 20 forms a heating body and the heating wire 88 is encapsulated by a porous ceramic matrix 36. The ceramic matrix 36 has an upper opening 22 and a lower opening 21. The upper opening 22 communicates with the lower opening 21 to form a ventilation air passage. The ventilation air passage can be a cylindrical opening screw the ceramic matrix 36. The heater unit 20 has a heater outside sidewall 35 with a porous outer surface 39 that is configured to receive a vape oil. Vape oil also called, vape juice or e-juice can be infused with a variety of different substances such as nicotine. The ceramic matrix 36 is a black ceramic due to the mixing of activated carbon particles with it when in a slurry form. The black ceramic has higher emissivity.

Preferably, activated carbon particles 37 are mixed with the ceramic slurry that forms the ceramic matrix 36. When the ceramic matrix 36 is formed, a number of voids 38 increases the porosity of the ceramic matrix 36. The activated carbon particles 37 can assist in absorbing impurities and can increase porosity and surface area. The activated carbon particles 37 are preferably ground as a powder for inclusion to the ceramic slurry. Activated carbon particles 37 are preferably between 2% and 20% of the total weight of the ceramic slurry. Absorption of oil 86 passes the oil along, and through the activated carbon particles 37.

Figure 2:
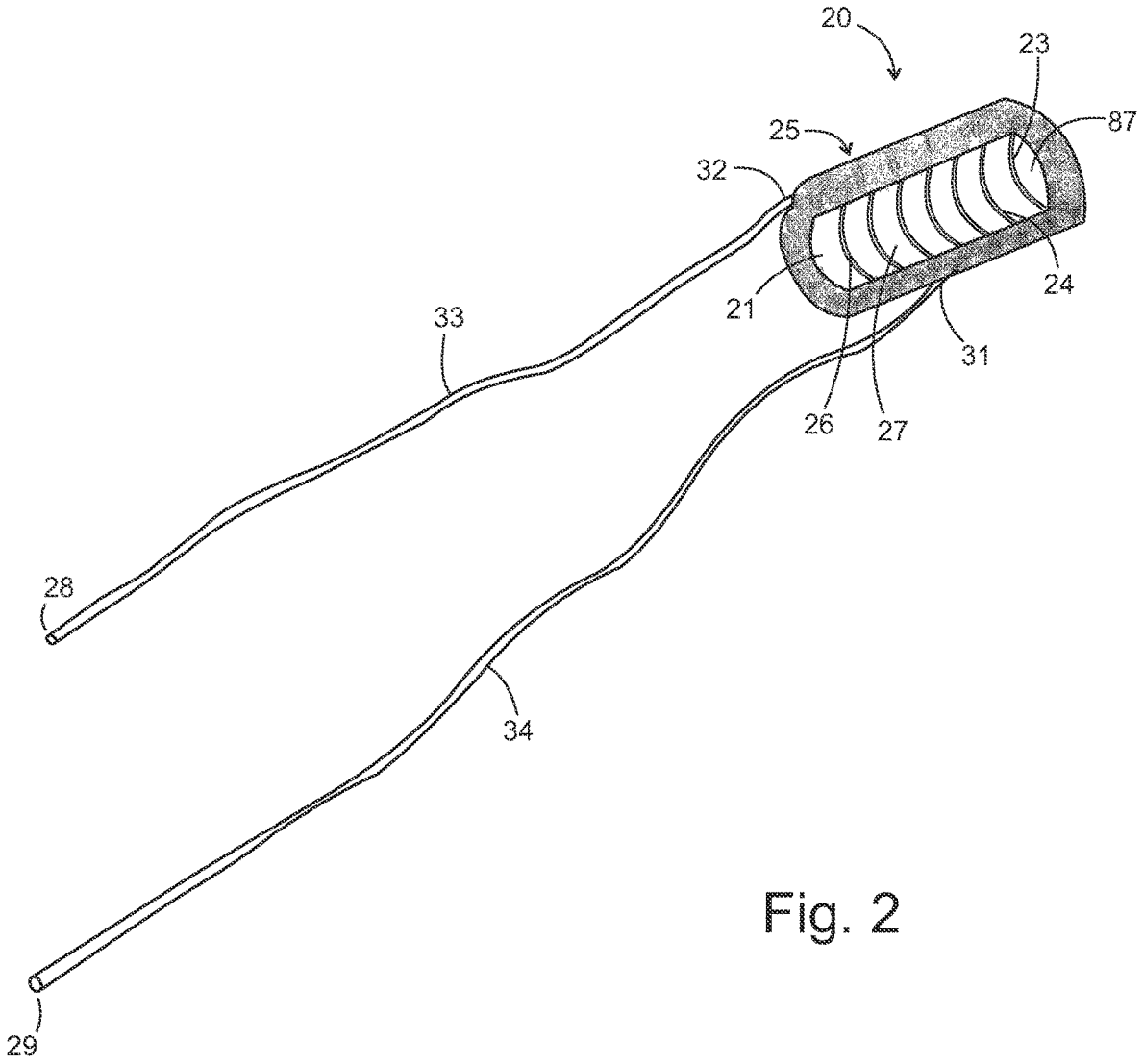
FIG. 2 is a is a cut away diagram showing internal construction of the heater unit.

As seen in FIG. 2, coil windings 25 are formed in the heater unit 20 in the heating body. The coil windings 25 include a first coil winding 23, and a second coil winding 24 at an upper portion near the ventilation air passage 87. The coil windings 25 can be formed near the heater inside sidewall 27, but are preferably not exposed. FIG. 2 is shown in cut away view, and the internal coil cavity 26 preferably has a heater inside sidewall 27 that does not expose the coil windings 25, but rather has the coil windings encapsulated within the ceramic matrix 36. The first lead wire tip 28 and the second lead wire tip 29 can be secured to a socket for ease of replacement.

Figure 3:
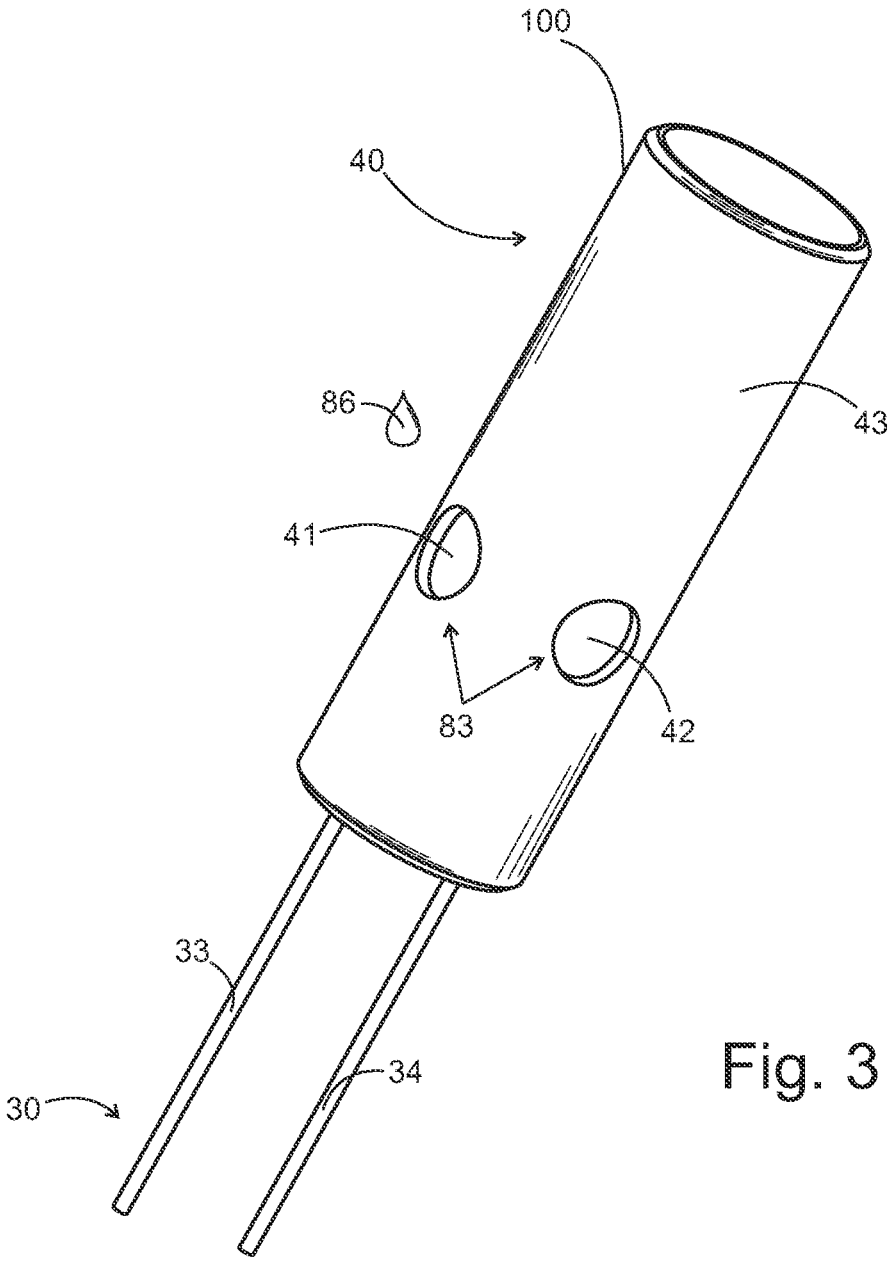
FIG. 3 is a diagram showing construction of the cover.

As seen in FIG. 3, a cover 40 is formed as a stainless steel cylinder. The cover 40 is formed as a shell having openings on a cover sidewall 100 of the cover. Openings may include a first side cover opening 41, and a second side cover opening 42. The heating body of the heater unit 20 can be sintered inside the stainless steel cover. Preferably, the outer shell has four circular through holes, that are sized and configured to allow oil to and absorb into the ceramic matrix 36. Absorption is improved with higher porosity, and inclusion of activated carbon particle powder can improve porosity.

Figure 4:
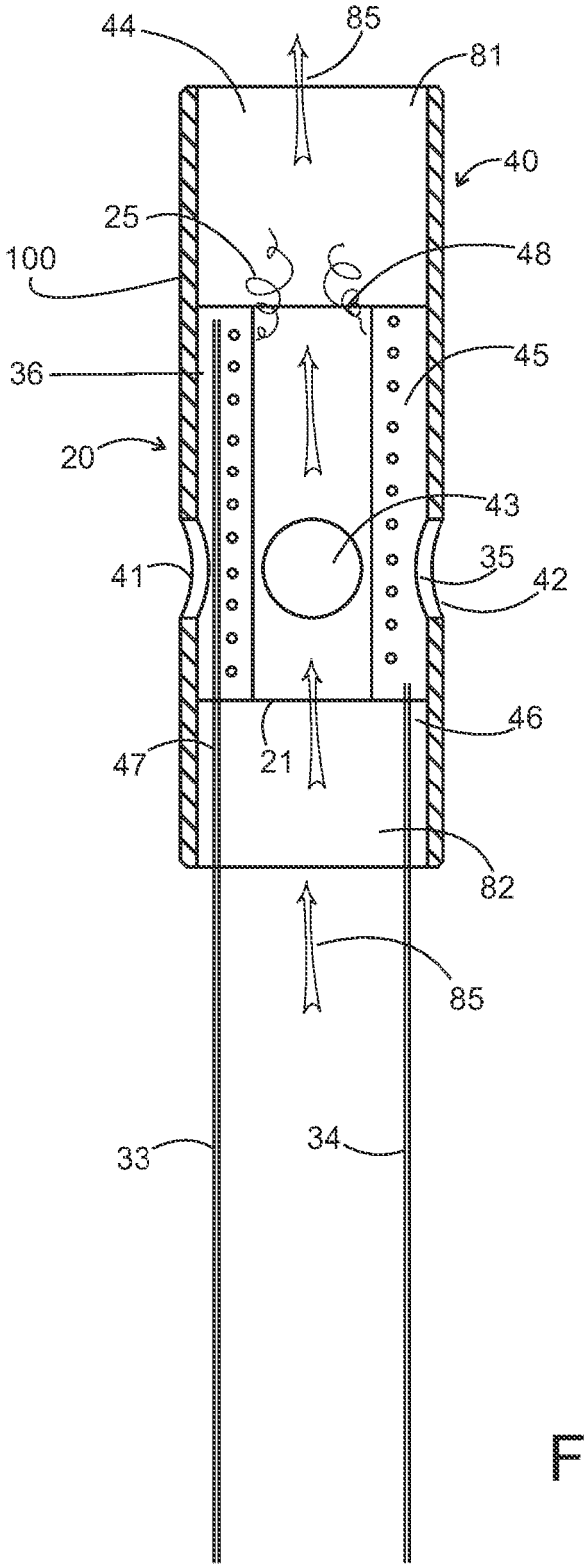
FIG. 4 is a cross section diagram showing the heater unit mounted in the cover.

As seen in FIG. 4, an airflow 85 formed as a stream of air passes from the bottom end of the cover 40 to the top end of the cover 40. The air flow 85 enters through the lower opening 21 and exits through the upper opening 22 of the heater unit 20. The heater unit 20 is preferably formed as a cylindrical heating body with a tubular construction. The cover 40 has an upper cavity 81, and a lower cavity 82. The cover 40 has a larger diameter than the heater unit 20, because the cover 40 covers most of the side wall of the heater unit 20. A third side cover opening 43 can be circular and at a 90° angle to the first side cover opening 41 and the second side cover opening 42. A fourth side cover opening can also be placed opposite the third side cover opening 43. Preferably, the cover 40 is axially symmetrical with the right side is symmetrical to the left side, and the front side symmetrical to the backside.

The upper cavity 81 prevents the smoke oil from being aspirated by a user. Since the upper cavity 81 has a larger diameter than the internal coil cavity 26, the airflow 85 slows and releases oil droplets from the airflow 85. The lower cavity 82 can be configured for storage of the smoke oil, also called vape oil 86 or vape juice. During operation, the heating wire 88 intermittently heats and atomizes the oil 86 and the oil 86 either creates smoke or vapor, or some sort of vape gas 84 destined for user inhalation.

Preferably, the outer cover 40 and the ceramic matrix 36 are integrated so that the ceramic matrix 36 is adheres to the outer cover 40. Since the ceramic matrix 36 is porous ceramic with a cornucopia of voids 38, the oil 86 can enter the matrix 36 from the oil inlet hole of the outer cover, and then penetrate inward from the ceramic pores, so the outer cover serves to fix the ceramic and enter oil inlet holes 83. The heater unit having 20 with the ceramic heating body acts as a wick for drawing oil 86. Under the action of its own gravity, the oil 86 penetrates inwards from the heater outside sidewall 35 until the oil 86 contacts the coil of the heating wire 88, and the heating wire 88 heats and atomizes the oil 86 to form vape gas 84.

The heating wire 88 is preferably a nickel-chromium composition heating wire, with an and outer surface is precoated with ceramic material. The ceramic material precoat layer can improve adhesion with the ceramic matrix 36. The construction steps can be first to form the coil on the heating wire 88, then precoat the outer surface with a ceramic material, then mix the activated carbon particles 37 with the ceramic matrix 36 to make a slurry, then introduce the slurry and the coil windings 25 into the stainless steel cover 40 with a die and heat the slurry and coil windings to form a unitary construction. By using the stainless steel cover 40 as a mold, the ceramic matrix 36 bonds to an inside sidewall of the stainless steel cover 40, so that it does not come loose or fall out easily during use.

A variety of different specifications can be varied such as the thickness of the ceramic coating, the flash point of the oil, and the thickness of the heating wire. With rudimentary analytical heat transfer calculations, undue experimentation would not be necessary for determining the construction of the electronic vaporizer. Preferably, the outer cover is made of a low-carbon stainless steel that is acid resistant and strong in oxidation resistance, moderate in hardness, strong in stability, and provides good heat dissipation.

The lead wires are provided at both ends of the heating wire 88, and the lead wires are connected to the power supply through the wires. The power supply can be a battery connected to a voltage or current controller circuit. By avoiding fibers such as cotton or polyester, the present invention allows the heating wire 88 to energize and heat up quickly without much concern of overheating. Thus, it is a key feature of the present invention that no fiber wick is used in conjunction with the ceramic matrix wick.

Preferably, the lead wires are arranged in parallel to avoid short-circuiting. A spacer can be formed between the lead wires for maintaining the lead in a parallel configuration. The body of the heating element is extruded from ceramic material and then sintered with heat. Preferably, the pore size varies in the ceramic heater body of the heating unit to allow wicking of different viscosities of oil. As lower viscosity oil is used, greater activated carbon should be introduced into the ceramic slurry mix to provide increased microporosity.

The invention claimed is:

1. An electronic cigarette burner element comprising:

a. a heating wire configured to heat and atomize vape oil, wherein the heating wire is formed with a coil and a pair of leads including a first lead and a second lead;

b. a porous ceramic matrix encapsulating the coil of the heating wire, wherein the coil windings are not exposed on an internal surface of the porous ceramic matrix;

c. a heating body formed when the heating wire is encapsulated by the porous ceramic matrix;

d. an outer cover fitting over the heating body, wherein the outer cover is made of metal;

e. a hole formed on the outer cover, wherein the hole is configured to receive vape oil, wherein the vape oil wicks through the porous ceramic matrix;

f. a ventilation air passage along a surface of the porous ceramic matrix, wherein the ventilation air passage emits a vape gas when the coil heats the vape oil, wherein the ventilation air passage is configured to receive fresh air and is configured to exhaust the gas; and g. a power supply supplying power to the first lead and the second lead.

2. The electronic cigarette burner element of claim 1, further comprising: second hole, and a third hole formed on the outer cover, wherein the hole, the second hole and the third hole are formed on a side wall of the outer cover.

3. The electronic cigarette burner element of claim 1, further comprising: a second hole, a third hole, and a fourth hole formed on the outer cover, wherein the hole, the second hole, the third hole, and the fourth hole are circular and formed on the outer cover.

4. The electronic cigarette burner element of claim 1, wherein the ventilation air passage passes through the coil of the heating wire, and wherein the ventilation air passage passes through the porous ceramic matrix.

5. The electronic cigarette burner element of claim 1, wherein the porous ceramic matrix has a tube shape.

6. The electronic cigarette burner element of claim 1, further including an upper cavity formed above the heating body, wherein the upper cavity is configured to prevent user oil aspiration, wherein the upper cavity is formed as a part of the outer cover.

7. The electronic cigarette burner element of claim 1, further including a lower cavity formed below the heating body, wherein the lower cavity is configured to store the vape oil.

8. The electronic cigarette burner element of claim 1, wherein the outer cover is made of stainless steel.

9. The electronic cigarette burner element of claim 1, wherein the heating body is sintered to the outer cover for secure attachment, wherein the heating wire has a nickel-chromium composition, wherein the outer cover is a tubular member.

10. The electronic cigarette burner element of claim 1, wherein the first lead and the second lead of the heating wire are arranged in parallel and connected to the power supply, wherein the power supply is a DC direct current power supply.

11. An electronic cigarette burner element comprising:

a. a heating wire configured to heat and atomize vape oil, wherein the heating wire is formed with a coil and a pair of leads including a first lead and a second lead;

b. a porous ceramic matrix encapsulating the coil of the heating wire, wherein the coil windings are not exposed on an internal surface of the porous ceramic matrix;

c. a heating body formed when the heating wire is encapsulated by the porous ceramic matrix;

d. an outer cover, wherein the heating body is formed within the outer cover;

e. activated carbon particles mixed into the ceramic matrix, wherein the ceramic matrix has voids, wherein the vape oil wicks through the porous ceramic matrix, wherein absorption of oil passes the oil along, and through the activated carbon particles of the ceramic matrix, wherein the activated carbon particles remain impregnated in the ceramic matrix while the oil is passing along and through the activated carbon particles;

f. a ventilation air passage along a surface of the porous ceramic matrix, wherein the ventilation air passage emits a vape gas when the coil heats the vape oil, wherein the ventilation air passage is configured to receive fresh air and is configured to exhaust the gas; and g. a power supply supplying power to the first lead and the second lead.

12. The electronic cigarette burner element of claim 11, further comprising: second hole, and a third hole formed on the outer cover, wherein the hole, the second hole and the third hole are formed on a side wall of the outer cover.

13. The electronic cigarette burner element of claim 11, further comprising: a second hole, a third hole, and a fourth hole formed on the outer cover, wherein the hole, the second hole, the third hole, and the fourth hole are circular and formed on the outer cover.

14. The electronic cigarette burner element of claim 11, wherein the ventilation air passage passes through the coil of the heating wire, and wherein the ventilation air passage passes through the porous ceramic matrix.

15. The electronic cigarette burner element of claim 11, wherein the porous ceramic matrix has a tube shape.

16. The electronic cigarette burner element of claim 11, further including an upper cavity formed above the heating body, wherein the upper cavity is configured to prevent user oil aspiration, wherein the upper cavity is formed as a part of the outer cover.

17. The electronic cigarette burner element of claim 11, further including a lower cavity formed below the heating body, wherein the lower cavity is configured to store the vape oil.

18. The electronic cigarette burner element of claim 11, wherein the outer cover is made of stainless steel.

19. The electronic cigarette burner element of claim 11, wherein the heating body is sintered to the outer cover for secure attachment, wherein the heating wire has a nickel-chromium composition, wherein the outer cover is a tubular member.

20. The electronic cigarette burner element of claim 11, wherein the first lead and the second lead of the heating wire are arranged in parallel and connected to the power supply, wherein the power supply is a DC direct current power supply.

* * * * *